US007571622B2

(12) United States Patent
Ballet et al.

(10) Patent No.: US 7,571,622 B2
(45) Date of Patent: Aug. 11, 2009

(54) REFRIGERANT ACCUMULATOR

(75) Inventors: Joseph Ballet, Bressolles (FR); Pierre Delpech, Fleurieu sur Saone (FR)

(73) Assignee: Carrier Corporation, Farmington, CT (US)

( * ) Notice: Subject to any disclaimer, the term of this patent is extended or adjusted under 35 U.S.C. 154(b) by 229 days.

(21) Appl. No.: 10/940,218

(22) Filed: Sep. 13, 2004

(65) Prior Publication Data

US 2006/0053832 A1 Mar. 16, 2006

(51) Int. Cl.

| | |
|---|---|
| ***F25B 43/00*** | (2006.01) |
| ***F25B 47/00*** | (2006.01) |
| ***B01D 24/00*** | (2006.01) |
| ***B01D 45/18*** | (2006.01) |
| ***B01D 46/42*** | (2006.01) |
| ***F26B 5/06*** | (2006.01) |

(52) U.S. Cl. ..... 62/474; 62/85; 62/512; 210/295; 55/428; 34/294; 34/299

(58) Field of Classification Search ..... 62/149, 62/324.4, 503, 470, 474, 475, 77, 85, 195, 62/512; 210/295; 55/428; 29/902; 34/294, 34/299, 300

See application file for complete search history.

(56) References Cited

U.S. PATENT DOCUMENTS

| | | | | |
|---|---|---|---|---|
| 2,556,292 | A * | 6/1951 | Neweum | 96/131 |
| 2,623,607 | A * | 12/1952 | Bottum | 62/474 |
| 3,175,342 | A * | 3/1965 | Balogh | 96/132 |
| 3,651,657 | A * | 3/1972 | Bottum | 62/196.3 |
| 4,029,580 | A * | 6/1977 | Lange | 210/136 |
| 4,045,977 | A | 9/1977 | Oliver, Jr. | |
| 4,954,252 | A * | 9/1990 | Griffin et al. | 210/136 |
| RE34,231 | E * | 4/1993 | Anderson, Jr. | 62/85 |
| 5,286,283 | A * | 2/1994 | Goodell | 96/113 |
| 5,685,087 | A * | 11/1997 | Flaugher et al. | 34/80 |
| 5,749,239 | A * | 5/1998 | Pomme | 62/225 |
| 5,937,670 | A | 8/1999 | Derryberry | |
| 6,223,555 | B1 | 5/2001 | Schroeder et al. | |
| 6,381,983 | B1 * | 5/2002 | Angelo et al. | 62/474 |
| 6,427,479 | B1 * | 8/2002 | Komatsubara et al. | 62/503 |
| 6,494,057 | B1 | 12/2002 | Schuster et al. | |
| 6,591,629 | B1 * | 7/2003 | Galbreath, Jr. | 62/292 |
| 6,668,572 | B1 * | 12/2003 | Seo et al. | 62/238.6 |
| 6,742,355 | B2 * | 6/2004 | Ichimura et al. | 62/474 |

* cited by examiner

*Primary Examiner*—William C Doerrler
(74) *Attorney, Agent, or Firm*—Bachman & LaPointe, P.C.

(57) ABSTRACT

A reversible cooling/heating system has an in-line accumulator/dryer unit. The accumulator/dryer unit has a body having first and second ports. A foraminate conduit is positioned at least partially within the body. A desiccant at least partially surrounds a first portion of the conduit.

30 Claims, 6 Drawing Sheets

REFRIGERANT ACCUMULATOR

BACKGROUND OF THE INVENTION

The invention relates to air conditioning and heat pump systems. More particularly, the invention relates to accumulator/dryer units for such systems.

Accumulator and dryer units are well known in the art. One application where accumulators are particularly important is in reversible systems (e.g., a system that may be run as a heat pump in one mode and an air conditioner in another mode). U.S. Pat. No. 6,494,057 discloses a combined accumulator/dryer unit used in a reversible system. In such a reversible system, first and second heat exchangers serve as a condenser and evaporator, respectively, in the air conditioner mode and as an evaporator and condenser, respectively, in the heat pump mode. The two heat exchangers are often dissimilar, being configured for preferred operation in one of the modes. Due, in part, to this dissimilarity, the combined mass of refrigerant in the two heat exchangers will differ between the modes. It is, accordingly, appropriate to buffer at least this difference in an accumulator. As in non-reversible systems, the accumulator may also serve to buffer smaller amounts associated with changes in operating conditions, and the like.

Nevertheless, there remains room for improvement in the art.

SUMMARY OF THE INVENTION

One aspect of the invention involves an apparatus having a compressor in a first flow path between first and second heat exchange apparatus. A desiccant unit is in a second flow path between the heat exchange apparatus. One or more valves are positioned to switch the apparatus between first and second modes. In the first mode, refrigerant flows from the second heat exchange apparatus to the first heat exchange apparatus along the second flow path. In the second mode, refrigerant flows from the first heat exchange apparatus to the second heat exchange apparatus along the second flow path.

In various implementations, the first heat exchange apparatus may be a refrigerant-to-water heat exchanger. The second heat exchange apparatus may be a refrigerant-to-air heat exchanger. The compressor may be a first compressor and a second compressor may be coupled in series with the first compressor in the first flow path. One or more valves may be in the first flow path. An expansion device may be in the second flow path between the buffer/desiccant unit and the second heat exchange apparatus. A strainer may be in the second flow path between the expansion device and the second heat exchange apparatus. A capillary tube distributor system may be in the second flow path between the strainer and the second heat exchange apparatus. The buffer/desiccant unit may include a shell having first and second ports, a foraminate conduit at least partially within the shell, and a desiccant at least partially surrounding a first portion of the conduit. In the first mode, a flow of refrigerant along the second flow path may enter the first port and split with: a first flow portion passing through the desiccant and then through the conduit first portion to an interior of the conduit and then out the second port; and a second flow portion bypassing the desiccant and passing through a second portion of the conduit to the interior of the conduit and then out the second port. In the second mode, a flow of refrigerant along the second flow path may enter the second port and split with: a first flow portion passing through the conduit first portion and then through the desiccant and then out the first port; and a second flow portion bypassing the desiccant and passing through the second portion of the conduit and then out the first port. A refrigerant accumulation in the first mode may be greater than in the second mode by at least 20% of a total refrigerant charge.

Another aspect of the invention involves a fluid filter and desiccant apparatus including a shell having first and second ports. A foraminate conduit is at least partially within the shell. A desiccant at least partially surrounds a first portion of the conduit.

In various implementations, the apparatus may have first and second partially overlapping flow paths between the first and second ports. The first flow path may pass through the first port and then through the desiccant and then through the conduit first portion to an interior of the conduit and then out the second port. The second flow path may pass through the first port and then bypass the desiccant and pass through a second portion or the conduit to the interior of the conduit and then out the second port.

Another aspect of the invention involves a method performed with an apparatus. The apparatus has a first flow path between first and second heat exchange apparatus. A compressor is in the first flow path. A second flow path is between the first and second heat exchange apparatus. A buffer/desiccant unit is in the second flow path. The apparatus is run in a first mode in which refrigerant flows from the second heat exchange apparatus to the first heat exchange apparatus along the second flow path. The apparatus is run in a second mode in which refrigerant flows from the first heat exchange apparatus to the second heat exchange apparatus along the second flow path and wherein an accumulation of the refrigerant builds up in the buffer/desiccant unit.

In various implementations, one or more valves may be actuated to switch the apparatus from the first mode to the second mode. The accumulation may build up by at least 20% of a total refrigerant charge.

Another aspect of the invention involves a refrigerant strainer for mounting in a receiver. The strainer has a conduit having an open first end and a second end, an internally threaded fitting in the second end, and an array of perforations in a sidewall. In various implementations, the perforations may account for 15-35% of an area of the sidewall. The conduit may be essentially circular in section with a diameter of 30-50 mm. The conduit may have a length of 0.25-2.0 m. The perforations may be essentially circular and have diameters of 0.5 1.2 mm.

Another aspect of the invention involves a refrigerant strainer and desiccant combination for mounting in a receiver The combination has a conduit having an open first end and a second end and an array of perforations in a sidewall. A desiccant surrounds a portion of the conduit. In various implementations, there may be means proximate the second end for registering the conduit in the receiver. The conduit length may be at least twice the desiccant length.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
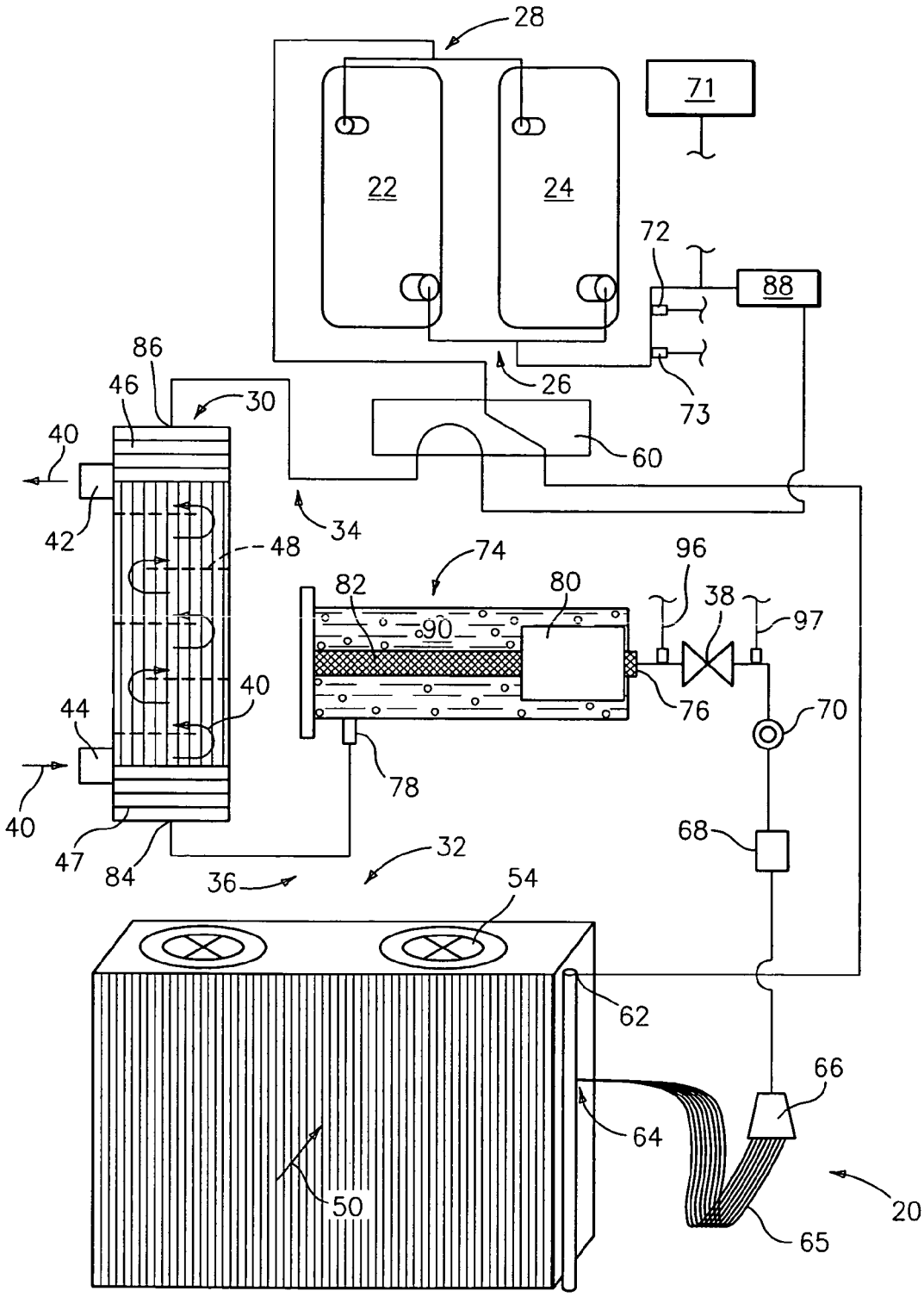
FIG. 1 is a partially schematic view of a refrigeration system in a cooling mode.

FIG. 1 shows a refrigeration system 20 operating in a cooling (e.g., chiller) mode. The system 20 includes exemplary first and second compressors 22 and 24 coupled in parallel to define a common inlet 26 and a common outlet 28. Single compressor systems, series compressor systems, and other compressor configurations are also appropriate. Exemplary compressors are scroll-type although other types (e.g., screw-type and reciprocating compressors) are possible.

The system 20 includes a first heat exchanger 30 and a second heat exchanger 32. Conduits and additional components define first and second flow paths 34 and 36 for passing refrigerant between the first and second heat exchangers 30 and 32. The compressors 22 and 24 are located in the first flow path 34 and an expansion device 38 is located in the second flow path 36.

In the exemplary implementation, the first heat exchanger 30 is a shell and tube heat exchanger as is typically used as an evaporator. For example, the first heat exchanger 30 may be a 2-4 refrigerant pass heat exchanger. Similarly, the second heat exchanger 32 is a fin (e.g., aluminum) and coil (e.g., copper) heat exchanger as is typically used as a condenser. In the exemplary implementation, the first heat exchanger 30 is located and coupled to exchange heat between the refrigerant and the heat exchange fluid 40 (e.g., water) entering the first heat exchanger through a water inlet 42 and exiting through a water outlet 44. The exemplary first heat exchanger 30 has tubes 45 passing the refrigerant between first and second plenums with first and second partition plates 46 and 47. Interspersed water baffles 48 define a circuitous water path between the water inlet 42 and water outlet 44.

In the cooling mode, the water 40 is chilled by the heat exchange and, upon exiting, may be directed to individual cooling units throughout the building or other facility or for other purposes. In alternative embodiments, the first heat exchanger 30 may use air or other fluid instead of water. The second heat exchanger exchanges heat between the refrigerant and an air flow 50 across the fins 52 and driven by fans 54.

In cooling mode operation, the first and second heat exchangers are used in the opposite of their normal (heating mode) roles. Compressed refrigerant exiting the outlet 28 passes through a four-way valve 60. As is discussed below, the valve 60 serves to shift operation between cooling and heating modes. The compressed refrigerant then enters the second heat exchanger 32 through a first port 62. In the second heat exchanger 32, the compressed refrigerant is cooled and condensed by heating the air flow 50. In the exemplary embodiment, the condensed refrigerant exits the second heat exchanger 32 through a number of second ports 64 coupled by capillary tubes 65 to a distributor manifold 66 which merges the flows from the various ports 64. The particular relevance of the distributor (formed by the capillary tubes 65 and manifold 66) is discussed below in the heating mode. In the exemplary embodiment, between the distributor manifold 66 and the expansion device 38, the condensed refrigerant passes through a first strainer 68 and a sight glass unit 70. The first strainer 68 serves to protect the expansion device 38 in cooling mode operation. The sight glass 70 may be used to determine the presence or lack of bubbles in liquid refrigerant passing therethrough. For example, bubbles may evidence leaks in the system. In the cooling mode, bubbles may indicate clogging of the strainer 68 tending to increase the pressure drop across that strainer.

The condensed refrigerant is expanded in the expansion device 38. An exemplary expansion device 38 is an electronic expansion valve whose operation is controlled by a control and monitoring subsystem 71. The control and monitoring subsystem 71 may be coupled to control various system components such as the compressors 22 and 24 and four-way valve 60 and to monitor data from various sensors (not shown) such as temperature and/or pressure sensors at various locations in the system (e.g., a temperature sensor 72 and a pressure sensor 73 located along the compressor suction line 26 and used to control the opening of the electronic expansion valve based upon the refrigerant superheat temperature set point at compressor inlet conditions). Advantageously, the refrigerant is essentially in a single-phase subcooled liquid state from the second heat exchanger 32 to the expansion device 38. However, at least once the refrigerant pressure is reduced in the expansion device 38, the refrigerant may be in substantially a two-phase gas/liquid condition (e.g., with vapor representing 20-25% of the flow mass). The expanded two-phase refrigerant flow enters an accumulator/dryer unit 74 through a first port 76 and exits through a second port 78. The exemplary accumulator/dryer unit 74 includes: a desiccant core 80 for drying the refrigerant flow of water; and a strainer 82. In the cooling mode, the strainer serves less as a filter and more to assist in homogenization/mixing of the two phases of refrigerant (e.g., as discussed below). The dried refrigerant enters the first heat exchanger 30 through a first port 84 and is warmed by the flow of fluid 40. The refrigerant at least partially further evaporates during thisheat exchange process and exits the first heat exchanger 30 through a second port 86 either as a single-phase superheated gas. Therefrom, the heated refrigerant passes through the four-way valve 60 and through a filter 88 before returning to the compressor inlet 26. The exemplary filter 88 serves to protect the compressors in both cooling and heating modes and may be formed as an inline filter with a replaceable core (e.g. perforated stainless steel).

In cooling mode operation, there is an accumulation 90 of two-phase refrigerant in the accumulator/dryer unit 74. The accumulation may be of essentially constant mass during steady state operation and is continually refreshed as refrigerant exits from the accumulation to the first heat exchanger 30 downstream and enters the accumulation from the expansion device upstream.

Figure 2:
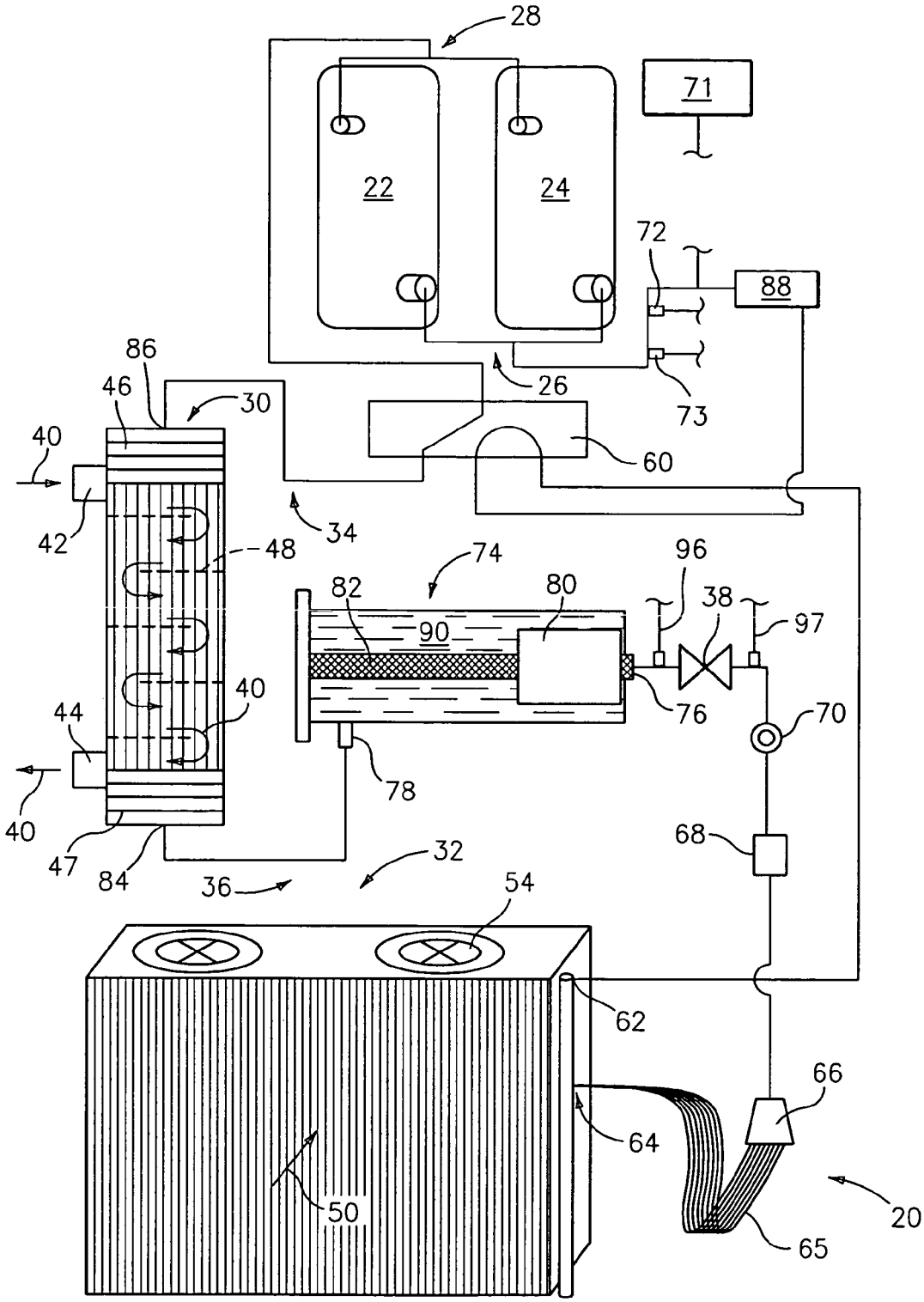
FIG. 2 is a partially schematic view of the system of FIG. 1 in a heating mode.

FIG. 2 shows the system 20 after the valve 60 has been actuated to place the system in the heating mode. Exemplary actuation is via rotation. In the heating mode, flow through the heat exchangers and intervening components along the second flow path 36 is reversed relative to the cooling mode. In the heating mode, the strainer 82 protects the expansion device 38 from debris originating upstream (e.g., in the first heat exchanger 30). In the heating mode, the first heat exchanger 30 serves its intended role as a condenser, condensing the refrigerant passing therethrough by giving off heat to the water 40. The second heat exchanger 32 serves its intended role as an evaporator receiving heat from the air flow 50. The refrigerant flow exiting the first heat exchanger 30 and entering the accumulator/dryer unit 74 may be essentially single-phase liquid. Accordingly, the accumulation 90 may essentially be a single-phase liquid as may be the flow entering the expansion device 38. The expanded flow exiting the expansion device 38 may be single-phase liquid or may be a two-phase flow. In the exemplary embodiment, in the heating mode the filter 68 may be essentially surplussage and need not have substantial homogenizing/mixing properties. These roles are achieved by the distributor system formed by the manifold 66 and the capillary tubes 65. Other known or yet-developed distributor systems may be used. In the heating mode, the role of the distributor system is to insure a desired phase and mass flow balance of refrigerant amongst the various tubes/coils of the second heat exchanger 32.

Due in part to the differences between the geometries and sizes of the heat exchangers 30 and 32, advantageous combined refrigerant mass contained within the two heat exchangers and other system components will differ between heating and cooling modes. The difference may also be influenced by operating conditions and by the locations, sizes, and other properties of additional system components. For example, in each mode the operating charge may be identified as the mass of refrigerant in the system excluding the accumulation in the accumulator. The operating charge for each mode may advantageously be chosen based upon performance factors. For example, it may be advantageous to maximize the energy efficiency ratio (EER) for the cooling mode and the coefficient of performance (COP) for the heating mode. In the exemplary system, more refrigerant mass may be contained in the components outside the accumulator in the cooling mode compared with the heating mode. The difference between these optimized charges may represent in excess of 20% of the cooling mode charge (e.g., 30%-40%). Accordingly, the accumulator/dryer unit 74 may be dimensioned to have sufficient excess volume to contain this difference in the heating mode.

Figure 3:
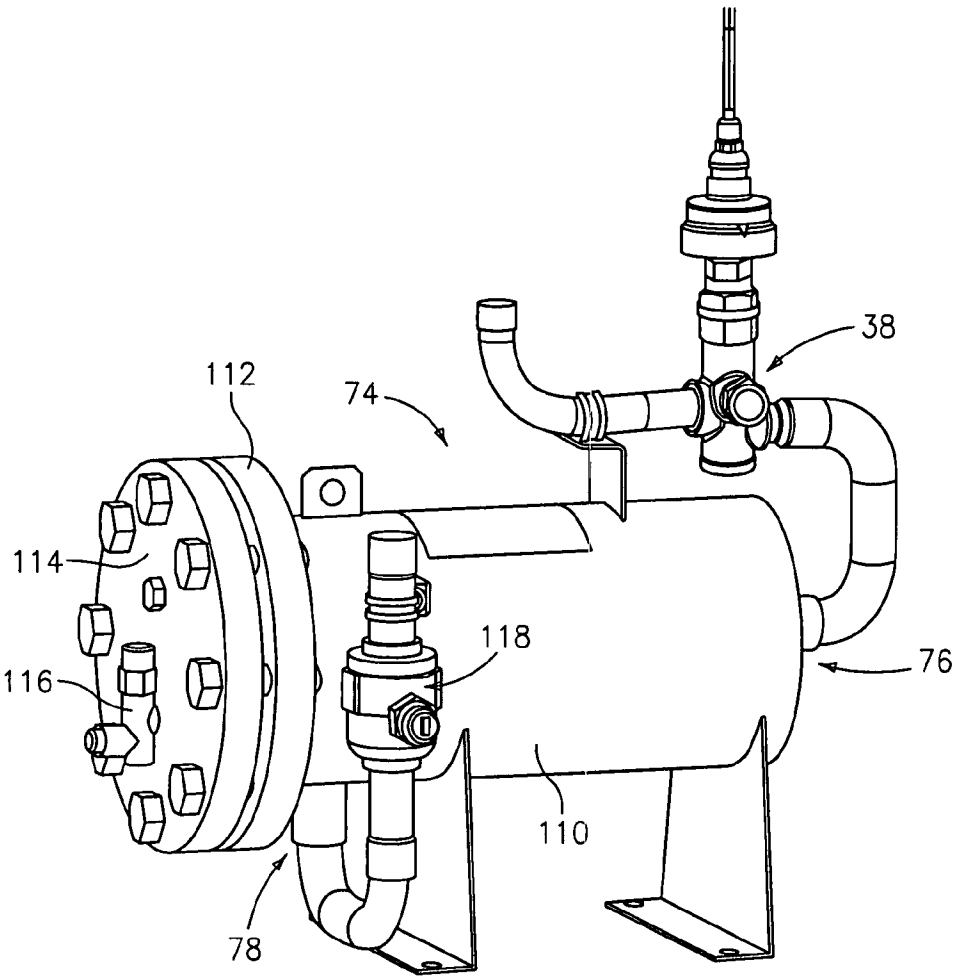
FIG. 3 is a view of an accumulator/dryer unit of the system of FIGS. 1 and 2.

FIG. 3 shows further details of an exemplary accumulator/dryer unit 74. A unit body includes a generally cylindrical shell 110 having a horizontally-oriented central longitudinal axis 500. The exemplary first port 76 is formed in an end plate at a first end of the shell and the exemplary second port 78 formed near the second end of the shell at the bottom. A flange 112 is formed at the shell second end and carries a cover 114. A service valve 116 may be provided in the cover or elsewhere to facilitate drainage during service. A ball valve 118 may be provided in the second flow path 36 between the accumulator/dryer second port 78 and the first heat exchanger first port 84. The ball valve 118 and the expansion valve 38 may be simultaneously closed for servicing of the accumulator/dryer unit 74. For example, this may be necessary to replace the core 80 with a fresh core and/or remove/clean/replace the strainer 82. In an initial use situation (e.g., when the system is first used after installation or after a major overall and/or component replacement), the system may advantageously be briefly used (e.g., for several hours) in a single mode. Single mode operation allows for the accumulation of debris on one side of each strainer or filter. The strainer or filters may be cleaned or replaced prior to any use in the other mode. The original core may also be replaced after that interval.

Figure 4:
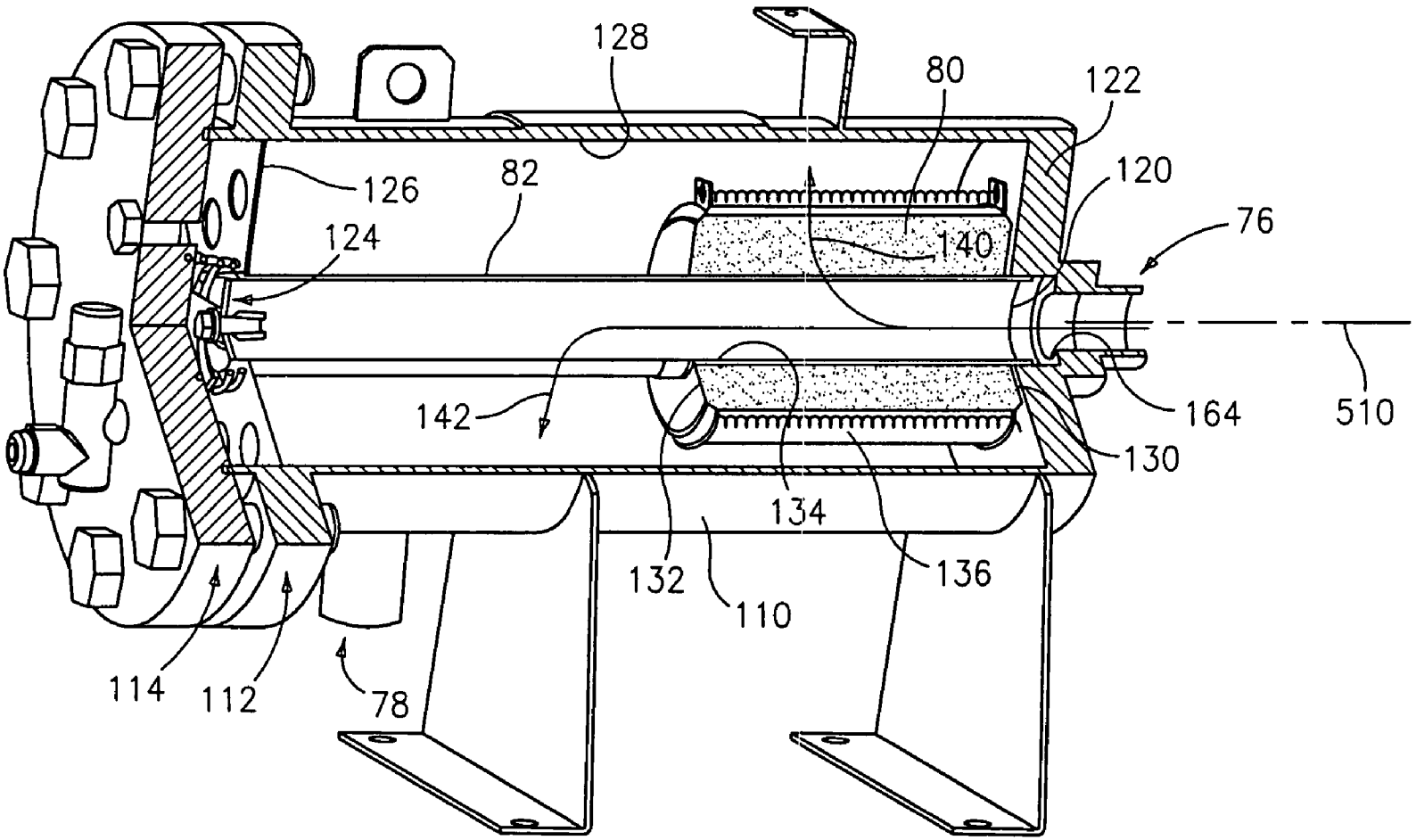
FIG. 4 is a cutaway view of the accumulator/dryer unit of FIG. 3.

FIG. 4 shows the longitudinal axis 500 as shared with the desiccant core 80 and strainer 82. The exemplary strainer 82 is formed as an elongate perforated tube extending from an open first end 120 mounted in the shell first end end plate 122 and open to the first port 76 to a closed second end 124 held by a support plate 126 spanning the shell interior surface 128 near the shell second end 124. The core 80 surrounds a first portion of the strainer 82 (e.g., near the shell first end). A second portion of the strainer is exposed within the shell interior. The core 80 is generally annular, having first and second ends 130 and 132 and inboard and outboard surfaces 134 and 136. In the cooling mode, there are two at least partially distinct flow paths through the accumulator/dryer unit 74. The two flow paths 140 and 142 overlap at the inlet 76 and diverge within the strainer 82. The first flow path 140 passes through the strainer first portion and then through the core 80, passing in through the core inboard surface 134 and exiting the core outboard surface 136. Outside of the core 80, the first flowpath 140 merges with the second flowpath 142 which has passed directly from the strainer interior through the strainer second portion. The merged flow then exits the second port 78. Deflection of the refrigerant flow by the closed end 124 increases mixing and homogenization. Mixing and homogenization may also be aided by appropriately optimized selection of the number size and density of strainer pores. For example, if there is too high a pressure drop across the strainer, there could be liquid flashing upstream of the electronic expansion valve in the heating mode and interfering with its operation. Too high a pressure drop in the cooling mode could provide flow restriction and loss of capacity of the electronic expansion valve. Too low a pressure drop (e.g., with bigger holes) could affect filtation effectiveness. Too low a pressure drop could also affect homogenization/mixing of the two phases entering the first refrigerant pass of the evaporator providing a significant loss of capacity at the evaporator.

In heating mode operation, the flow path splits substantially in reverse directions. Accordingly, in the exemplary embodiment, in both modes only a portion of the flow passes through the desiccant. Advantageously, the percentage of the flow passing through the desiccant is sufficient so that, over time, an appropriate amount of water is removed from the refrigerant. An exemplary strainer 82 is formed from stainless steel tubing approximately 40 mm in diameter and 0.5 mm in wall thickness. The tubing is perforated by exemplary 0.8 mm diameter holes arranged in two sets of rings with circumferential spacing of 1.5 mm. The holes of each set of rings are out of phase with those of the other set at a stagger angle of 30° off longitudinal. The exemplary holes account for 25% of the total area of the tube (pre-perforation).

Figure 5:
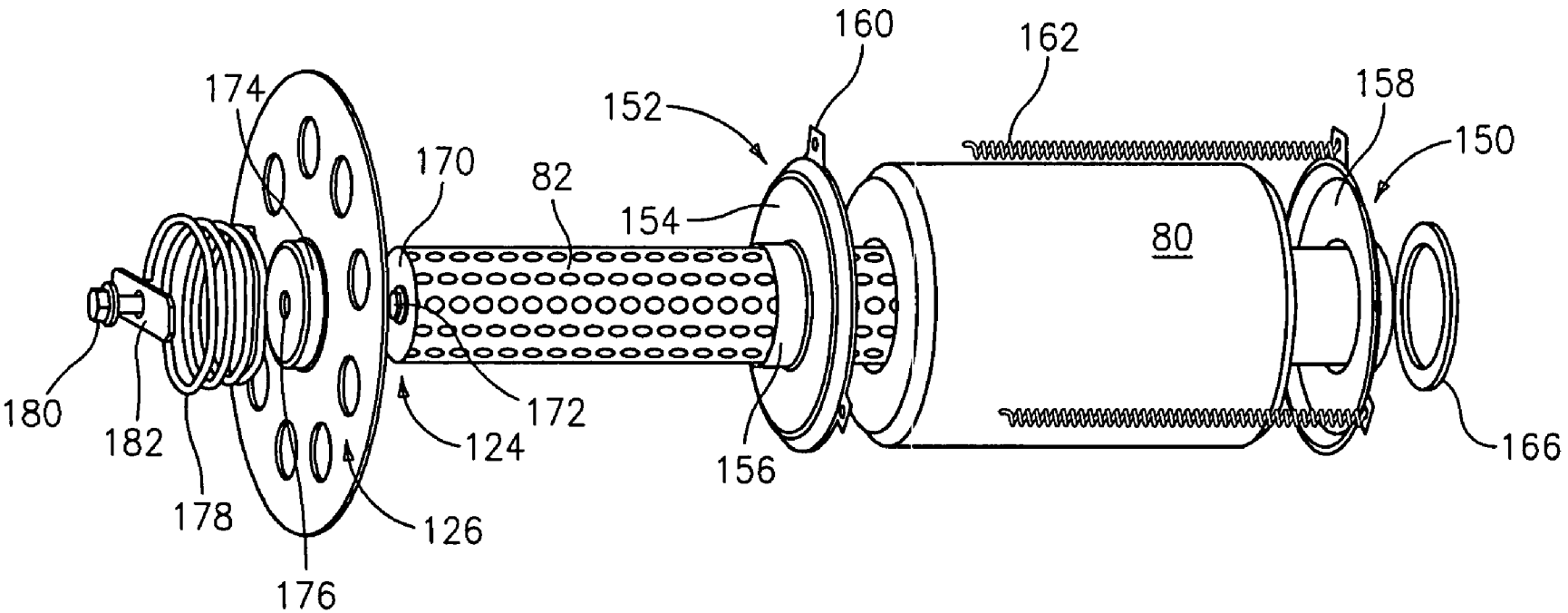
FIG. 5 is a partially exploded view of a filter/dryer subassembly of the unit of FIGS. 3 and 4.

FIG. 5 shows further details of the innards of the exemplary accumulator/dryer unit 74. The core 80 is held between core first and second end plates 150 and 152 each having a web 154 extending generally radially outward from a longitudinally outward-facing sleeve 156 and having a longitudinal inboard surface 158 contoured to engage the adjacent core end. The sleeves or collars 156 have interior surfaces dimensioned to accommodate the exterior surface of the strainer 82. In the exemplary embodiment, the core end plates 150 and 152 have radially extending tabs 160 for engaging opposite ends of a plurality (e.g., three) of springs 162 to longitudinally hold the end plates and core together as a stack. The outer surface of the sleeve of the core first end plate 150 is dimensioned to be received within a bore 164 (FIG. 4) in the shell first end plate 122. A gasket 166 (FIG. 5) seals between an inboard surface of the shell first end plate 122 and an outboard surface of the web 154 of the core first end plate 150.

FIG. 5 further shows the strainer second end 124 as plugged or otherwise closed by a strainer end plate 170 (e.g., welded, brazed, or press-fit in place). The end plate 170 has an internally-threaded fitting 172. The support plate 126 has a longitudinally outwardly projecting hub 174 which concentrically receives the second end portion of the strainer 82 and has a hub end plate with a central aperture 176. A spring 178 is mounted to the outboard surface of the support plate 126 such as by means of a bolt 180 extending through a bracket 182 and through the aperture 176 into threaded engagement with the threaded fitting 172. In the exemplary embodiment, the spring 178 diverges radially outward from the support plate 126 to facilitate insertion of the bracket 182 to capture only one or more proximal end turns of the spring surrounding the hub 174. In operation, the outboard (distal) end of the spring is in compressive engagement with the inboard face of the cover 114 to bias the strainer first end into the bore 164.

Figure 6:
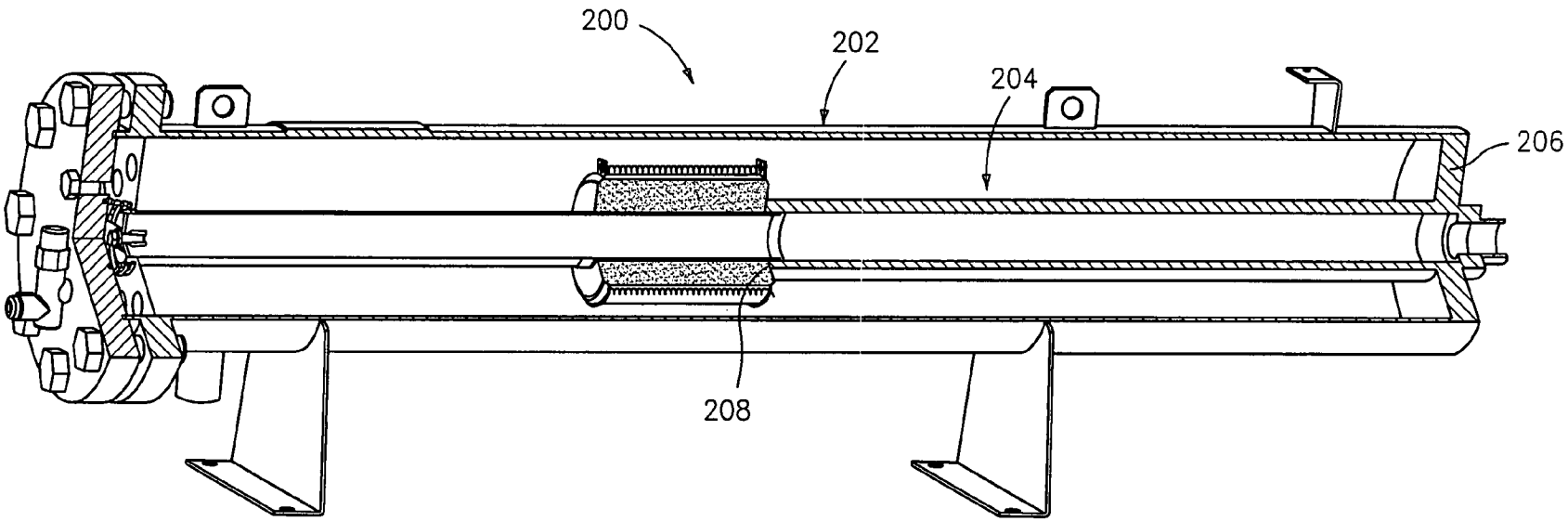
FIG. 6 is a cutaway view of an alternate accumulator/dryer unit.

FIG. 6 shows an alternate accumulator dryer unit 200 which may be otherwise similar to the unit 74 of FIG. 3 but which has a longer shell 202 to increase internal volume to accommodate a larger charge difference. In the exemplary embodiment, the extra shell length is associated, internally, with the presence of a spacer tube 204 extending from the shell first end plate 206. The spacer tube may be unitarily or otherwise integrally formed with the end plate 206 or may be separately formed (e.g., fit into a bore similar to that of the end plate 122 of FIG. 4). In the exemplary embodiment, the spacer tube 204 has a distal end 208 having an end portion telescopically receiving the sleeve of the core first end plate 150 and having a rim engaging the gasket 166. Accordingly, the length of the spacer tube 204 may be selected to permit use of the same FIG. 5 parts as are used in the first accumulator/dryer unit 74. This permits a substantial economy of manufacturing, inventory, and the like while providing accumulators of differing capacity. Alternatively, however, other configurations offering higher accumulator volumes than the first accumulator/dryer unit 74 may be used. Some of these, too, may be configured to use identical FIG. 5 components.

In an exemplary engineering process to size the accumulator/dryer unit for a given application, one may initially look to operating conditions. These include operating conditions such as the ambient environmental temperature at the second heat exchanger 32. For example, this may be a temperature of outdoor air flowing across the second heat exchanger 32. In one example, this temperature is 7 C (dry bulb; 6 C wet bulb) for the heating mode and 35 C for the cooling mode. Another parameter may be water temperature at the inlet 42. For example, this may be 40 C for the heating mode and 12 C for the cooling mode. Another parameter is desired water temperature at the outlet 44. For example, this may be 45 C for the heating mode and 7 C for the cooling mode. An experimental sizing of the accumulator/dryer may make use of temperature sensors 96 and 97 on either side of the expansion valve 38. The appropriate one of such sensors may be used to measure the degree of refrigerant subcooling immediately upstream of the expansion device 38 in each of the heating and cooling modes. The accumulator may be sized so that the active charge in the system outside the accumulator (and, in particular, the amount of refrigerant in the first heat exchanger 30) in the heating mode is effective to produce 5-6 C of subcooling. A similar amount of subcooling may be provided in the cooling mode. The total refrigerant charge or total unit charge may be selected to maximize EER in the cooling mode for the target cooling mode operating conditions. The receiver may be sized to accumulate sufficient refrigerant in the heating mod to provide a desired COP at target heating mode operating conditions. Exemplary sizing provides accumulations of 20-45% of the total-refrigerant charge.

One or more embodiments of the present invention have been described. Nevertheless, it will be understood that various modifications may be made without departing from the spirit and scope of the invention. For example, when implemented as a modification of an existing system, details of the existing system may influence details of the particular implementation. Accordingly, other embodiments are within the scope of the following claims.

What is claimed is:

1. An apparatus comprising:

a first heat exchange apparatus;

a second heat exchange apparatus;

a first flow path between the first and second heat exchange apparatus;

a compressor in the first flow path;

a second flow path between the first and second heat exchange apparatus;

a buffer/desiccant unit in the second flow path in series with the first and second heat exchange apparatus wherein the buffer/desiccant unit comprises:

a shell having first and second ports;

a foraminate conduit at least partially within the shell; and a desiccant at least partially surrounding a first portion of the conduit; and one or more valves positioned to switch the apparatus between:

a first mode in which refrigerant flows from the second heat exchange apparatus to the first heat exchange apparatus along the second flow path, a flow of the refrigerant along the second flow path enters the first port and splitting with:

a first flow portion passing through the desiccant and then through the conduit first portion to an interior of the conduit and then out the second port; and a second flow portion bypassing the desiccant and passing through a second portion of the conduit to the interior of the conduit and then out the second port; and a second mode in which refrigerant flows from the first heat exchange apparatus to the second heat exchange apparatus along the second flow path, a flow of the refrigerant along the second flow path enters the second port and splitting with:

a first flow portion passing through the conduit first portion and then through the desiccant and then out the first port; and a second flow portion bypassing the desiccant and passing through the second portion of the conduit and then out the first port.

2. An apparatus comprising:

a first heat exchange apparatus;

a second heat exchange apparatus;

a first flow path between the first and second heat exchange apparatus;

a compressor in the first flow path;

a second flow path between the first and second heat exchange apparatus;

a buffer/desiccant unit in the second flow path; and one or more valves positioned to switch the apparatus between:

a first mode in which refrigerant flows from the second heat exchange apparatus to the first heat exchange apparatus along the second flow path, a flow of the refrigerant along the second flow path entering the first port and splitting with:

a first flow portion passing through the desiccant and then through the conduit first portion to an interior of the conduit and then out the second port; and a second flow portion bypassing the desiccant and passing through a second portion of the conduit to the interior of the conduit and then out the second port; and a second mode in which refrigerant flows from the first heat exchange apparatus to the second heat exchange apparatus along the second flow path, a flow of the refrigerant along the second flow path entering the second port and splitting with:

a first flow portion passing through the conduit first portion and then through the desiccant and then out the first port; and a second flow portion bypassing the desiccant and passing through the second portion of the conduit and then out the first port.

3. The apparatus of claim 2 wherein:

the first heat exchange apparatus is a refrigerant-to-water heat exchanger; and the second heat exchange apparatus is a refrigerant-to-air heat exchanger.

4. The apparatus of claim 2 wherein:

the compressor is a first compressor;

a second compressor is coupled in series with the first compressor in the first flow path; and the one or more valves are in the first flow path.

5. The apparatus of claim 2 further comprising:

an expansion device in the second flow path between the buffer/desiccant unit and the second heat exchange apparatus; and a strainer in the second flow path between the expansion device and the second heat exchange apparatus, the buffer/desiccant unit also including a strainer.

6. The apparatus of claim 2 further comprising:

an expansion device in the second flow path between the buffer/desiccant unit and the second heat exchange apparatus;

a strainer in the second flow path between the expansion device and the second heat exchange apparatus; and a capillary tube distributor system in the second flow path between the strainer and the second heat exchange apparatus.

7. The apparatus of claim 2 wherein:

a refrigerant accumulation in the first mode is greater than in the second mode by at least 20% of a total refrigerant charge.

8. The apparatus of claim 2 wherein:

the desiccant consists essentially of a molecular sieve.

9. The apparatus of claim 2 wherein:

said compressor is a first compressor in parallel with a second compressor.

10. A fluid filter and desiccant apparatus comprising:

a shell having first and second ports;

a foraminate conduit at least partially within the shell;

a desiccant at least partially surrounding a first portion of the conduit; and first and second partially overlapping flow paths between the first and second ports wherein:

the first flow path passes through the first port and then through the desiccant and then through the conduit first portion to an interior of the conduit and then out the second port; and the second flow path passes through the first port and passes through a second portion of the conduit, without passing through desiccant, to the interior of the conduit and then out the second port.

11. The apparatus of claim 10 wherein:

the foraminate conduit comprises a perforated metallic tube of circular section.

12. The apparatus of claim 10 wherein:

the desiccant comprises a molecular sieve.

13. A method for operating an apparatus wherein said apparatus comprises: a first flow path between first and second heat exchange apparatus; a compressor in the first flow path; a second flow path between the first and second heat exchange apparatus; and a buffer/desiccant unit in the second flow path; and said method for operating said apparatus comprises:

running the apparatus in a first mode in which a refrigerant flows from the second heat exchange apparatus to the first heat exchange apparatus along the second flow path through the buffer/desiccant unit; and running the apparatus in a second mode in which said refrigerant flows from the first heat exchange apparatus to the second heat exchange apparatus along the second flow path through the buffer/desiccant unit and wherein an accumulation of said refrigerant builds up in the buffer/desiccant unit, wherein:

in at least one of the first mode and the second mode, a portion of the refrigerant flow through the buffer/desiccant unit bypasses desiccant exposure.

14. The method of claim 13 further comprising:

actuating one or more valves to switch the apparatus from said first mode to said second mode.

15. An apparatus comprising:

a first heat exchange apparatus;

a second heat exchange apparatus;

a first flow path between the first and second heat exchange apparatus;

a compressor in the first flow path;

a second flow path between the first and second heat exchange apparatus;

a buffer/desiccant unit in the second flow path; and one or more valves positioned to switch the apparatus between:

a first mode in which refrigerant flows from the second heat exchange apparatus to the first heat exchange apparatus along the second flow path, a flow of the refrigerant along the second flow path entering the first port and splitting with:

a first flow portion passing through the desiccant and then through the conduit first portion to an interior of the conduit and then out the second port; and a second flow portion bypassing the desiccant and passing through a second portion of the conduit to the interior of the conduit and then out the second port; and a second mode in which refrigerant flows from the first heat exchange apparatus to the second heat exchange apparatus along the second flow path, a refrigerant accumulation in the first mode being greater than in the second mode by at least 20% of a total refrigerant charge.

16. A method for operating an apparatus wherein said apparatus comprises: a first flow path between first and second heat exchange apparatus; a compressor in the first flow path; a second flow path between the first and second heat exchange apparatus; and a buffer/desiccant unit in the second flow path; and said method for operating said apparatus comprises:

running the apparatus in a first mode in which a refrigerant flows from the second heat exchange apparatus to the first heat exchange apparatus along the second flow path; and running the apparatus in a second mode in which said refrigerant flows from the first heat exchange apparatus to the second heat exchange apparatus along the second flow path and wherein an accumulation of said refrigerant builds up in the buffer/desiccant unit by at least 20% of a total refrigerant charge.

17. The method of claim 16 further comprising:
actuating one or more valves to switch the apparatus from said first mode to said second mode.

18. The apparatus of claim 10 wherein:
the desiccant surrounds a portion of a length of the conduit.

19. The apparatus of claim 10 wherein:
the desiccant has an inboard and outboard surfaces extending between first and second ends; and
the inboard surface at least partially surrounds a portion of a length of the conduit.

20. The apparatus of claim 10 wherein:
the desiccant coaxially surrounds a portion of a length of the conduit.

21. The apparatus of claim 10 wherein:
the desiccant is an annulus having inboard and outboard surfaces, the conduit at least partially within the annulus.

22. The apparatus of claim 10 wherein:
the desiccant has inboard and outboard surfaces extending between first and second ends.

23. The apparatus of claim 10 wherein:
the conduit extends horizontally and the desiccant is partially above and partially below the conduit.

24. The apparatus of claim 10 wherein:
the desiccant and conduit are removable and replaceable as a unit.

25. The apparatus of claim 1 wherein:
the desiccant has inboard and outboard surfaces extending between first and second ends.

26. The apparatus of claim 1 wherein:
the buffer/desiccant unit has:
a housing having first and second ports along the flow path; and
a desiccant and a strainer within the housing; and
flow between the first and second ports must pass through at least one of the desiccant and strainer.

27. The method of claim 13 further comprising:
servicing the buffer/desiccant unit by removing a desiccant and installing a replacement desiccant.

28. The method of claim 13 wherein the buffer/desiccant unit comprises: a shell having first and second ports; a foraminate conduit at least partially within the shell; and a desiccant at least partially surrounding a first portion of the conduit, the method further comprising:
removing the conduit and desiccant;
cleaning the conduit; and
reinstalling the conduit and installing a replacement desiccant.

29. The apparatus of claim 15 wherein:
the desiccant consists essentially of a molecular sieve.

30. The apparatus of claim 15 wherein:
the desiccant has inboard and outboard surfaces extending between first and second ends and surrounds said conduit first portion.

* * * * *

UNITED STATES PATENT AND TRADEMARK OFFICE

CERTIFICATE OF CORRECTION

PATENT NO. : 7,571,622 B2
APPLICATION NO. : 10/940218
DATED : August 11, 2009
INVENTOR(S) : Ballet et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 476 days.

Signed and Sealed this

Seventh Day of September, 2010

David J. Kappos

David J. Kappos
*Director of the United States Patent and Trademark Office*